United States Patent [19]

Cabourne

[11] Patent Number: 4,840,569

[45] Date of Patent: Jun. 20, 1989

[54] HIGH DENSITY ROTARY CONNECTOR

[75] Inventor: Michael K. Cabourne, Hacienda Heights, Calif.

[73] Assignee: ITT Corporation, New York, N.Y.

[21] Appl. No.: 211,783

[22] Filed: Jun. 27, 1988

[51] Int. Cl.[4] ..... H01R 9/09

[52] U.S. Cl. ..... 439/65; 29/882; 200/8 R; 439/260

[58] Field of Search ..... 439/65, 66, 74, 59–62, 439/67, 260, 267; 29/874–884; 200/51.06, 292, 8 R

[56] References Cited

U.S. PATENT DOCUMENTS

| | | | |
|---|---|---|---|
| 3,129,990 | 4/1964 | Rice | 339/17 |
| 3,173,732 | 3/1965 | James | 339/17 |
| 3,636,499 | 1/1972 | Winklebleck | 439/260 |
| 3,851,297 | 11/1974 | Munro | 339/176 |
| 3,922,054 | 11/1975 | Dechelette | 339/75 |
| 3,930,308 | 1/1976 | Munro | 29/630 |
| 3,951,493 | 4/1976 | Kozel | 339/17 |
| 3,985,413 | 10/1976 | Evans | 339/17 |
| 4,057,311 | 11/1977 | Evans | 339/17 |
| 4,261,631 | 4/1981 | Morlaix | 339/75 |
| 4,266,839 | 5/1981 | Aikens | 339/75 |
| 4,370,012 | 1/1983 | Grabbe | 339/75 |
| 4,370,017 | 11/1983 | Grabbe | 339/176 |
| 4,477,133 | 10/1984 | Cosmo | 339/17 |
| 4,488,766 | 12/1984 | Cosmo | 339/75 |
| 4,518,210 | 5/1985 | Morrison | 339/17 |
| 4,528,530 | 1/1985 | Ketchen | 439/65 |
| 4,541,678 | 9/1985 | Lumpp | 339/75 |
| 4,638,405 | 1/1987 | Smith | 361/399 |
| 4,647,131 | 3/1987 | Van Woensel | 339/74 |
| 4,713,014 | 12/1987 | Conroy-Wass | 439/67 |
| 4,720,156 | 1/1988 | Beers | 439/260 |

*Primary Examiner*—Neil Abrams

*Attorney, Agent, or Firm*—Thomas L. Peterson

[57] ABSTRACT

A connector is provided for connecting two rows of closely-spaced miniature conductive pads on a pair of circuit boards, which enables zero insertion force for a circuit board and allows connection to be made without thereafter moving the inserted circuit board. The apparatus includes an elongated bobbin having a pivot axis extending along its length and an electrically conductive wire extending in multiple helical turns about the bobbin. The wire is severed along each turn, and forms a pair of contacts along each turn that are spaced further from the pivot axis than adjacent portions of the bobbin and wire. The bobbin is pivotally mounted so it can be pivoted between a connect position wherein the contact portions of each wire turn contact pads on the two boards to connect them, and a disconnect position wherein the contact portions do not contact the pads.

12 Claims, 4 Drawing Sheets

FIG. 1
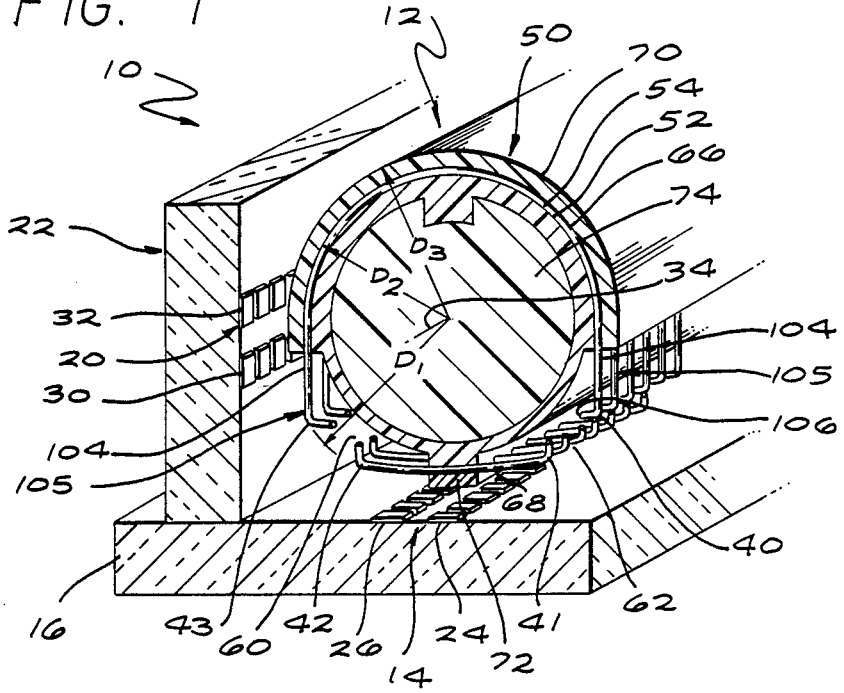
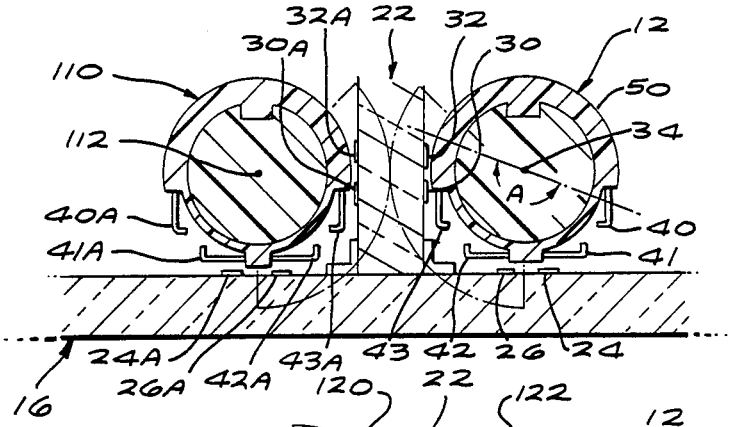
FIG. 2
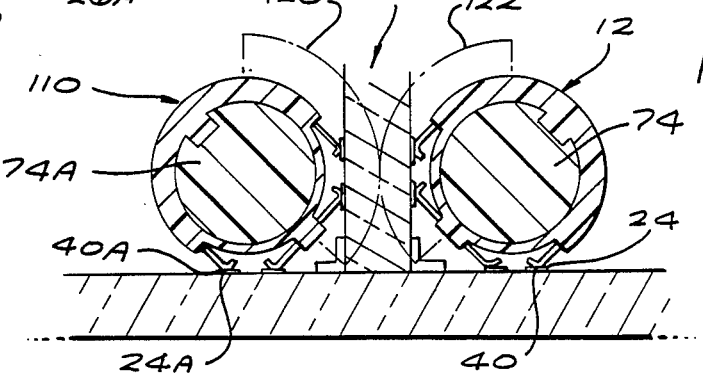
FIG. 3

FIG. 7
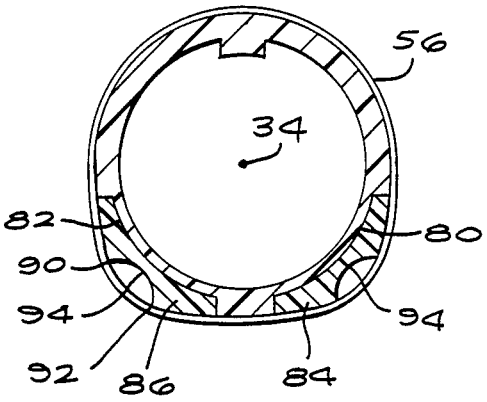
FIG. 8
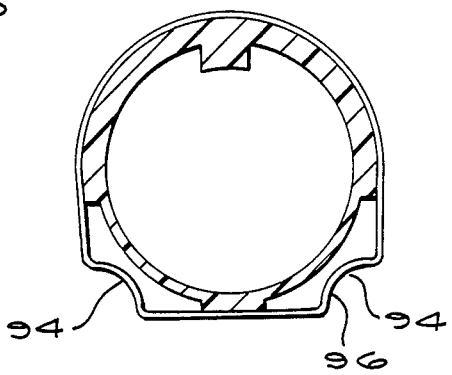
FIG. 9
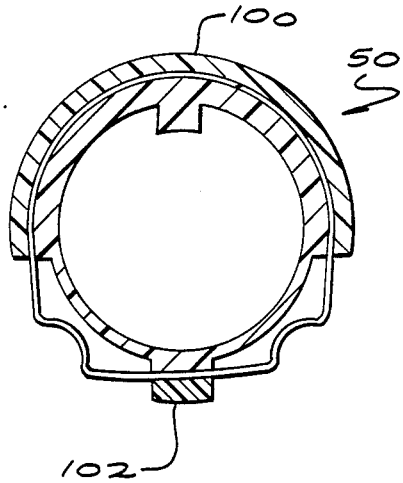
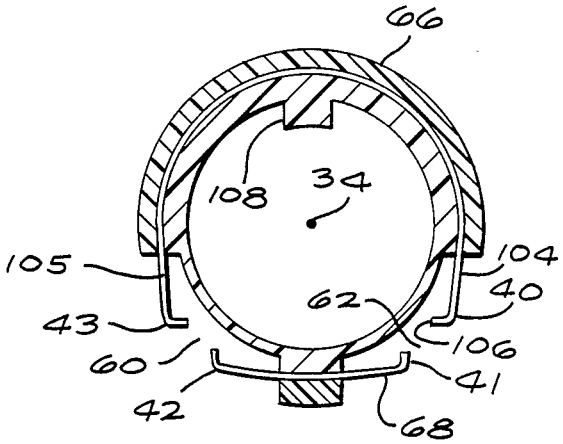
FIG. 10

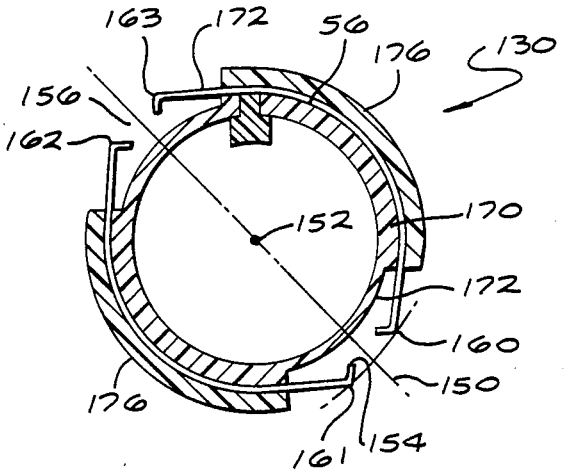
FIG. 12
FIG. 13
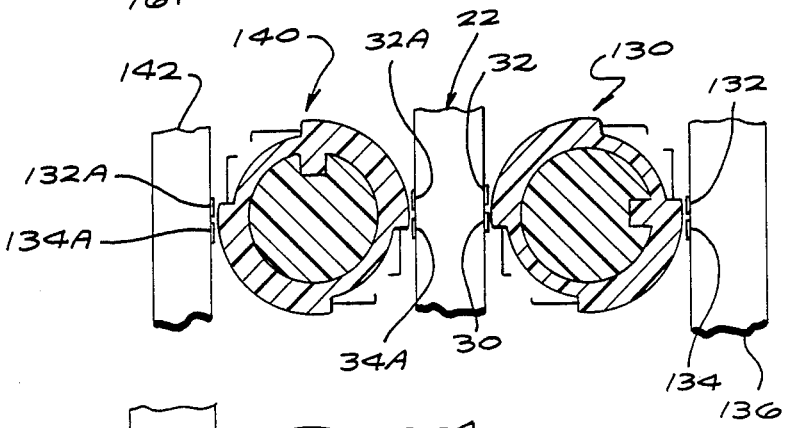
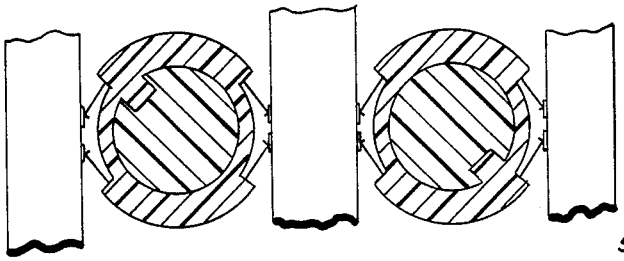
FIG. 14
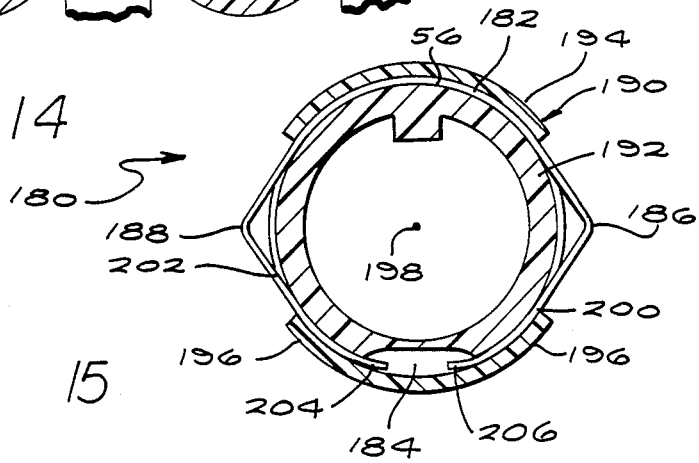
FIG. 15

HIGH DENSITY ROTARY CONNECTOR

BACKGROUND OF THE INVENTION

Some electronic apparatus such as computers, are designed to receive a removable module or circuit board and make connections between a large number cf conductive pads on the inserted board and corresponding pads on a backplane or already-installed circuit board of the electronic apparatus. One approach, described in U.S. Pat. No. 3,951,493 by Kozel involves wrapping a conductor helically about a largely cylindrical elastomeric core and severing the wire at two locations in each turn to form multiple conductors spaced along the core. The core with conductors thereon is sandwiched and compressed between a pair f circuit boards having rows of conductive pads, to interconnect the pads of the circuit boards. While this approach is satisfactory in many applications, it has certain disadvantages, including the fact that wiping contact is not made against both conductive pads of an interconnected pair, and that a removable circuit board must either be inserted with considerable force, or it or the already-installed circuit board must be deflected after insertion. In many applications, a removable circuit board is easily damaged, and it is preferable to enable its installation with substantially zero insertion force into a fixed position from which it does not move, and to then enable wiping contact to be made between conductive pads on the board and corresponding pads on the already-installed board. A high density connector which could be constructed at moderate cost and make such connections, would be of considerable value.

SUMMARY OF THE INVENTION

In accordance with one embodiment of the present invention, a high density rotary connector and method for constructing it are provided, which enables the making of wiping contact between the pads of a removable module or board and the pads of a backplane or stationary board or the like in an electronic apparatus, without requiring considerable insertion force for the removable board or movement of either board after insertion. The rotary connector includes an elongated bobbin having a pivot axis extending along its length. An electrically conductive wire extends in multiple helical turns about the bobbin, with each wire turn having at least one gap therein. Each turn of the wire has a portion attached to the bobbin, and also has a pair of spaced contact portions that are free of attachment to the bobbin so they can bend and that lie further from the pivot axis of the bobbin than adjacent portions of the wire turn. The bobbin is pivotally supported so it can pivot between a connect position wherein the contact portions of the wire turns engage pads of the removable and stationary circuit boards or the like, and a disconnect position wherein the contact portions are away from the pads.

The connector can be constructed by forming an elongated bobbin and wrapping a conductive wire in a largely helical winding thereabout. Locations along each of the wire turns are secured to the bobbin while at least two contact portions along each turn are free of attachment to the bobbin. The wire is severed at at least one location along each turn. The free contact portions along each wire turn are positioned so they lie further from the pivot axis than adjacent portions of the wire turn.

The novel features of the invention are set forth with particularity in the appended claims. The invention will be best understood from the following description when read in conjunction with the accompanying drawings.

BRIEF DESCRIPTION OF THE DRAWINGS

FIG. 1 is a partial sectional and isometric view of a high density rotary connector and a pair of circuit boards whose conductive pads can be interconnected by the rotary connector.

FIG. 2 is a sectional view of the apparatus of Fig. 1, showing two rotary connectors in disconnect positions.

FIG. 3 is a view similar to that of FIG. 2, but showing the rotary connectors in connect positions.

FIG. 7 is a sectional end view of the rotary connector of FIG. 1, shown in an early phase of manufacture which is the same as that of FIG. 5.

FIG. 8 is a view similar to that of FIG. 7, but at a later stage when the spacer bars have been removed.

FIG. 9 is a view similar to that of FIG. 8, but at a later stage when retainers have been applied to the bobbin.

FIG. 10 is a view similar to that of FIG. 9, but at a later stage when the wire has been severed to leave gaps at each turn of the wire.

FIG. 12 is a sectional end view of a rotary connector constructed in accordance with another embodiment of the invention.

FIG. 13 is a view similar to that of FIG. 12 showing two rotary connectors and how they are positioned with respect to circuit boards, with the connectors in a disconnect position.

FIG. 14 is a view similar to that of FIG. 13, but showing the connectors in a connect position.

FIG. 15 is a sectional view of a rotary connector constructed in accordance with another embodiment of the invention.

DESCRIPTION OF THE PREFERRED EMBODIMENTS

Figure 4:
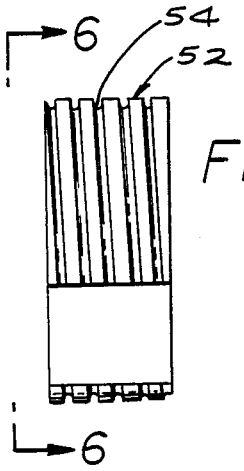
FIG. 4 is a partial side elevation view of the bobbin of the rotary connector of FIG. 1.

FIG. 1 illustrates a connection system 10 which includes a contact assembly in the form of a rotary connector 12 for connecting conductive pads 14 on a base in the form of a backplane circuit board 16 to conductive pads 20 on another base in the form of a removable module circuit board 22. The conductive pads 14 are arranged in two rows 24, 26, while the conductive pads 20 on the removable circuit board are arranged in two corresponding rows 30, 32. The contact assembly 12 has four rows of contacts 40–43, and can rotate about a pivot axis 34 to bring the contacts in the four rows against the pads in the rows 24., 26, 30, 32.

Figure 5:
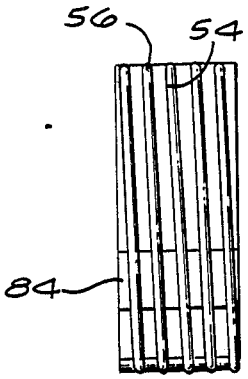
FIG. 5 is a view similar to that of FIG. 4, but with spacer bars on the bobbin and wire wound about the bobbin.

The rotary contact includes a frame 50 formed from a bobbin 52 having a helical groove 54 therein (FIG. 4). An electrically conductive wire 56 (FIG. 5) is wound in multiple turns about the groove 54. After the wire is wound, each turn of wire is severed to leave gaps shown in FIG. 1 at 60, 62. The severing leaves the contacts 40–43 at opposite sides of the gaps, and leaves first and second wire segments 66, 68 along each wire turn. A pair of retainers 70, 72 hold each wire segment securely to the bobbin. A rotatably mounted shaft 74 supports the bobbin in rotation about its pivot axis 34.

Figure 6:
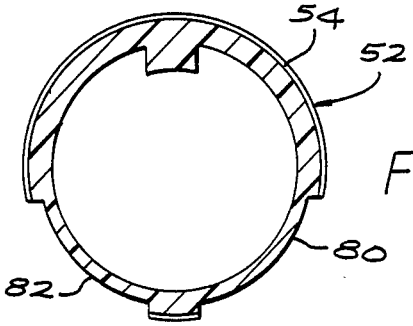
FIG. 6 is a sectional view of the bobbin of FIG. 4, with 360° of the groove shown.

FIGS. 6–10 illustrate steps in the construction of the rotary contact. As shown in FIGS. 6 and 7, the bobbin has cutout regions 80, 82 leaving empty spaces extending deeper than the bottom of said groove 54 and lying closer to the pivot axis than the bottom of the groove. A pair of spacer bars 84, 86 are temporarily mounted in these cutout regions. The spacer bars do not have grooves in them corresponding to the helical grooves in the bobbin. Each spacer bar has a pair of locations 90, 92 spaced further from the pivot axis 34 of the bobbin than any adjacent portion of the bobbin (or of the retainers, applied later). Each spacer bar has a recess 94 between the extended locations 90, 92. The wire 56 is wound about the combination of bobbin and spacer bars to form a coil.

As shown in FIG. 8, after the wire has been wound, all of the wire turns are deformed into the recesses 94 of the spacer bars. The spacer bars are then removed to leave deformed wire portions 96 free of support. As shown in FIG. 9, a pair of retainers 100, 102 are mounted to the bobbin to securely hold portions of each wire turn thereto. As shown in FIG. 10, all turns of the wire are severed, as by a laser beam or mechanically. In FIG. 10, severing occurs at four locations to leave two gaps 60, 62 in each wire turn. As a result, there are two wire segments 66, 68 in each wire turn. Each wire segment has two opposite ends, forming the contacts 40, 43. At each wire end, the wire forms a contact portion 105 which has an inner end 104 attached to the bobbin and an outer end, such as at extreme end 106 and at contact 40, the contact portion 105 being cantilevered out and free of attachment to the frame so its contact can be easily deflected radially towards the pivot axis 34. The extreme end 106 of each free wire end is bent largely radially inwardly to leave a smooth wire portion at the contact 40. The bobbin has a key 108 that can fit into a keyway of the shaft to rotatably connect them.

FIG. 2 shows the contact assembly 12 and another similar contact assembly 110 that are mounted with their pivot axes 34, 112 on opposite sides of the removable circuit board 22. The backplane circuit board 16 has an additional pair of rows of contact pads 24A, 26A, while the removable circuit board has an additional pair of rows of contact pads 30A, 32A. In the rotational positions of the connector shown in FIG. 2, the contacts 40–43 and 40A–43A are all disconnected from corresponding pads. In FIG. 3, each connector assembly has been rotated by 45° to bring all contacts on the rotary connectors into contact with the pads on the circuit boards. As shown in FIG. 1, the contacts such: as 43 are located a distance $D_1$ from the pivot axis 34 of the bobbin which is greater than the distance $D_3$ of the periphery of the retainer 70. The distance $D_1$ is also greater than the distance $D_2$ of most of each turn of the wire. As indicated in FIG. 2, it is necessary for the contacts 40–43 to lie further from the pivot axis than portions of the frame 50, only along an angle A where the rotary connector passes across the surfaces of the circuit boards.

Figure 11:
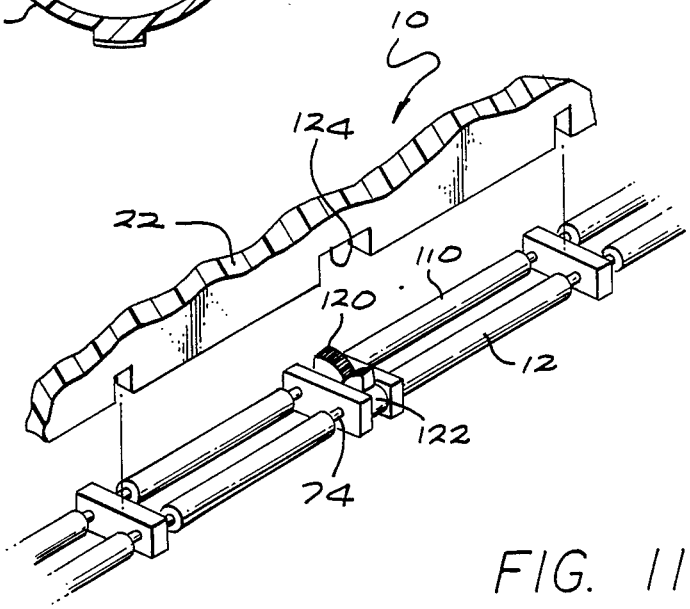
FIG. 11 is an exploded perspective view of the system of FIGS. 1–3, showing limited detail but also showing additional portions of the system.

Each rotary connector may have hundreds of contacts that simultaneously press against a face of the removable circuit board when the connector is rotated. It is desirable that the two rotary connectors 12, 110 be rotatable in synchronism so their contacts first press against the opposite sides of the removable circuit board at the same time, to avoid damage to the circuit board. FIG. 3 indicates a pair of gear segments 120, 122 fixed to the shafts 74, 74A of the two rotary connectors to cause them to rotate in synchronism. FIG. 11 is a simplified exploded view of the connection system 10, showing that the gear segments 120, 122 that couple a pair of rotary connectors 12, 110, can lie in a cutout 124 of the removable circuit board 22.

In one rotary connection applicant has designed, the bobbin has a diameter $D_2$ of about one-quarter inch, the wire 56 is formed of beryllium-copper and has a diameter of 5 mils (one mil equals one-thousandth inch) and is wound at a pitch of 10 mils.

FIGS. 12–14 illustrate another design for a connection assembly or rotary connector 130 which enables the connection of rows of conductive pads 132, 134 on a stationary circuit board or backplane 136, to corresponding conductive pads 30, 32 of the removable module or circuit board 22. The system preferably includes a second rotary connector 140 moveable in synchronism with the first rotary connectory 130 to connect the rows of contacts 32A, 34A of the removable circuit board with corresponding pads 132A, 134A on another stationary circuit board 142. The rotary connector 130 of FIG. 12 is substantially symmetrical about a diametric line 150 extending through the pivot axis 152. That is, the gaps 154, 156 in the wire 56 lie on diammetrically opposite sides of the pivot axis, to leave the contacts 160–163 in pairs lying on diametrically opposite sides of the rotary conductor. The construction of the rotary conductor is accomplished by steps similar to those of FIGS. 7–10, except that the bobbin 170 has cutout regions 172 on diametrically opposite sides, the spacer bars are temporarily placed in these cutouts during winding, and the two retainers 174, 176 are of the same size.

FIG. 15 illustrates still another rotary connector 180 wherein each turn 182 of wire 56 has only one gap 184 therein. The wire turn or segment 182 forms two contacts 186, 188 where the wire is free of attachment to the connector frame 190. The frame 190 includes a bobbin 192 and retainers 194, 196. At each contact or contact location 186, 188 the wire is free to deflect radially inward towards the pivot axis 196 of the frame and/or parallel to the pivot axis 198. The end portions 200, 202 of each turn, which each lie between a contact 186, 188 and a severed end 204, 206 can be allowed to slide a small distance on the frame 190, to facilitate radially inward deflection of the contacts. The rotary connector 180 is designed for connecting a single row of contacts on one circuit board with a single row of contacts on another circuit board. It may be noted that in all of the rotary connectors described herein, the contacts are spaced along a helix rather than a circle, and the pads of the circuit boards are offset slightly to account for this. It is possible to wind the wire so the pitch of the helix is irregular along each turn.

Thus, the invention provides an apparatus and method for constructing it, which enables the connection of rows of pads on two circuit boards or the like, by moving the contacts against the pads of the circuit boards rather than moving the circuit boards. The connector can include an elongated bobbin pivotally mounted about its axis, and an electrically conductive wire extending in multiple turns abc ut the bobbin. The wire can be formed with gaps in each turn to for contacts at each turn that are electrically isolated from the contacts of other turns. Each contact is free of attachment to the bobbin so the wire can bend near the contact, and each contact lies further from the pivot axis than adjacent portions of the frame (which includes the bobbin) that holds the wire to the bobbin. During winding of the wire about the bobbin, spacer bars can be used to form a portion of each turn so it lies further from the pivot axis than the rest of the wire turn. Thereafter, the spacer bars can be removed to leave the extending wire portions in place.

Although particular embodiments of the invention have been described and illustrated herein, it is recognized that modifications and variations may readily occur to those skilled in the art and consequently it is intended to cover such modifications and Equivalents.

What is claimed is:

1. Apparatus for connecting together each of a plurality of conductive pads lying in a row on a first base, to a corresponding one of a plurality of pads lying in a second row on a second base, comprising:

an elongated bobbin having a pivot axis extending along its length;

an electrically conductive wire extending in multiple turns about said bobbin, with said turns spaced from one another along the length of the bobbin, and with said wire having at least one gap therein in each turn, each turn of the wire being attached to said bobbin along part of its length but having spaced contact portions forming contacts that are free of attachment to said bobbin so each contact portion can deflect by bending of the contact portion, said contacts lying further from said pivot axis than adjacent portions of said wire turn;

means for supporting said first and second bases and for supporting said bobbin in pivoting about said pivot axis at a distance from said rows to bring said contacts against and away from said pads as said bobbin pivots about said axis between first and second rotational positions.

2. The apparatus described in claim 1 wherein:

said wire has first and second gaps in each turn to leave two wire end portions forming two of said contacts at each gap, each wire end portion lying further from said pivot axis than adjacent portions of said wire turn;

said first and second bases each have two rows of conductive pads positioned so upon turning said bobbin to said first rotational position each of two contacts at said first gap engages a pad on a different one of said rows of the first base, and each of the two contacts at said second gap engages a pad in a different one of said rows of the second base.

3. The apparatus described in claim 1 wherein:

said bobbin has a largely helical groove, said wire lying in said groove.

4. The apparatus described in claim 1 including:

a second bobbin and a second wire substantially the same as said first mentioned bobbin and wire; and wherein said first base has opposite faces and has a row of conductive pads on each of said faces;

said means for supporting is constructed to pivotally support said first and second bobbins with their pivot axes on opposite sides of said first base, and is constructed to pivotally couple said first and second bobbins to pivot them in synchronism so their contacts move substantially in unison against and away from a corresponding one of said row of pads on said first base.

5. A connector comprising:

a frame which includes a bobbin having a largely helical groove forming multiple turns and having a pivot axis;

an electrically conductive wire wound in multiple turns about said bobbin and lying in said groove;

each turn of said wire having a pair of spaced gaps leaving a pair of wire end portions at each gap, each wire end portion having an inner end held to said frame and a free outer end lying away from said frame and free to deflect toward and away from said bobbin;

means for supporting said bobbin in pivoting about said pivot axis.

6. The apparatus described in claim 5 including:

a board having a pair of opposite faces and having two rows of pads on each face;

a second bobbin, wire, and supporting means that are largely identical to said first named bobbin, wire and supporting means;

said first and second supporting means support said bobbins at said opposite board faces and couple said bobbins so they turn in synchronism.

7. The apparatus described in claim 5 wherein:

said bobbin has a pair of cutout regions extending along its length, said cutout regions leaving empty spaces lying closer to said pivot axis than the bottom of said groove, and said gaps in each wire turn lie at said cutout regions.

8. A method for constructing a rotatable connector having a multiplicity of conductors which have opposite terminals that make wiping contact with conductive pads located in two rows of pads when the connector is turned to a connect position, and which break contact with the pads when the connector is turned to a disconnect position, comprising:

forming an elongated bobbin which has a pivot axis;

wrapping an electrically conductive wire around said bobbin in a largely helical winding to form multiple wire turns spaced along the length of the bobbin, and holding locations along each of said wire turns securely to said bobbin while leaving at least two other locations along each wire turn free of attachment to said bobbin;

severing said wire at at least one location along each turn; and establishing said two wire locations that are free of attachment to said bobbin so they lie further from said pivot axis than adjacent portions of each turn of the wire, whereby when said bobbin is pivoted about said axis the two free wire locations can make wiping contact with pads in said two rows.

9. The method described in claim 8 wherein:

said step of establishing said two wire locations includes placing at least one spacer against said bobbin prior to said step of wrapping; and including applying a retainer to hold said wire to said bobbin;

said spacer including a far portion lying further from said axis than adjacent portions of said bobbin and said retainer, to form said free wire portions so they lie further from said axis than most of each wire turn, and including removing said spacer from said bobbin after said step of wrapping.

10. The method described in claim 9 wherein:

said spacer has a recess, and including pressing said wire into said recess to leave an inwardly bent wire portion after said step of wrapping, and said step of severing including severing two spaced locations along said wire at said inwardly bent wire portion.

11. The method described in claim 8 wherein:

said step of severing including cutting the wire at a location free of attachment to said bobbin to leave said two free wire locations, with each free wire location being in the form of a cantilevered wire end portion with a captured inner end and with a free end that can be easily deflected.

12. A method for forming a rotary contact with multiple terminals comprising:

forming a bobbin having an axis and having a largely helical groove, therein and with a pair of cutouts spaced about the axis, said groove being interrupted at said cutouts;

placing a pair of spacer bars in said cutouts, each bar having a recess therein;

winding an electrically conductive wire around said groove and spacer bars to lie in multiple turns about said bobbin;

deforming said wire turns into said spacer bar recesses to leave two deformed wire portions in each turn;

removing said spacer bars from said bobbin;

forming a gap in each wire turn at each of the deformed wire portions thereof;

mounting said bobbin pivotally about said axis.

* * * * *